US007706713B2

(12) United States Patent
Terai et al.

(10) Patent No.: US 7,706,713 B2
(45) Date of Patent: Apr. 27, 2010

(54) IMAGE FORMING APPARATUS AND CLEANING METHOD THEREFOR

(75) Inventors: Yuji Terai, Minamiashigara (JP); Yasutomo Ishii, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 294 days.

(21) Appl. No.: 11/482,767

(22) Filed: Jul. 10, 2006

(65) Prior Publication Data

US 2007/0104504 A1 May 10, 2007

(30) Foreign Application Priority Data

Nov. 4, 2005 (JP) ..... 2005-320727

(51) Int. Cl.
*G03G 15/02* (2006.01)
*G03G 15/16* (2006.01)
*G03G 21/00* (2006.01)

(52) U.S. Cl. ..... 399/100; 399/101; 399/357

(58) Field of Classification Search ..... 399/100, 399/101, 357
See application file for complete search history.

(56) References Cited

U.S. PATENT DOCUMENTS 6,038,415 A * 3/2000 Nishi et al. ..... 399/111
6,701,105 B2 * 3/2004 Funabashi ..... 399/100
2002/0154922 A1 10/2002 Ohno et al. ..... 399/174
2005/0191081 A1 * 9/2005 Muraishi et al. ..... 399/100
2006/0165431 A1 7/2006 Yanagida et al. ..... 399/100
2006/0222400 A1 * 10/2006 Matsuguma et al. ..... 399/100

FOREIGN PATENT DOCUMENTS

JP A-08-166705 6/1996
JP 9-90709 A 4/1997
JP 9-179464 A 7/1997
JP A-09-222776 8/1997
JP A-11-143183 5/1999
JP 2004-361916 A 12/2004
JP 2005-17317 A 1/2005
JP A-2005-24675 1/2005
JP 2005-43715 A 2/2005
JP 2005-141031 A 6/2005
KR 2002-0064657 A 8/2002

* cited by examiner

*Primary Examiner*—David M Gray
*Assistant Examiner*—Joseph S Wong
(74) *Attorney, Agent, or Firm*—Morgan, Lewis & Bockius LLP

(57) ABSTRACT

An image forming apparatus includes an image bearing member, a charging roll that charges the image bearing member by rotating in contact with the image bearing member, and a cleaning member that removes materials adhered to the surface of the charging roll by contacting the surface of the charging roll. The cleaning member includes a foam body having an average cell diameter of 0.18 mm to 1.0 mm, and a ten point height of irregularities (Rz: JIS B0601-1982) of the charging roll is 1 μm to 17 μm.

14 Claims, 6 Drawing Sheets

IMAGE FORMING APPARATUS AND CLEANING METHOD THEREFOR

BACKGROUND

1. Technical Field

The present invention relates to an image forming apparatus and a cleaning method therefor, and more particularly, to an image forming apparatus having a charging roll of a contact charging system for charging the surface of an image bearing member, which is driven in rotation, in contact therewith while rotating, and a cleaning member for cleaning the charging roll, and a cleaning method for such an image forming apparatus.

2. Related Art

Heretofore, charging devices such as a scorotron charger that makes use of a corona discharge phenomenon are often used as a charging device of an image forming apparatus such as a copy machine, a printer, and the like that employ an electrophotographic system. In the charging device making use of the corona discharge phenomenon, a problem arises in that ozone and nitrogen oxides, which adversely affect the human bodies and the global environment, are generated thereby. In contrast, the contact charging system, which charges an image bearing member by causing an electrically conductive charging roll to come into direct contact with the image bearing member recently goes mainstream because it greatly reduces generation of ozone and nitride oxides and is excellent in power efficiency.

However, the charging device of the contact charging system has a problem that the surface of the charging roll is liable to be made dirty due to foreign materials deposited thereon because the charging roll is in contact with an image bearing member at all times. The surface of the image bearing member, which repeatedly executes an image forming operation, enters an area of a charging process downstream side of a transferring process after it passes through a cleaning process in which foreign materials such as remaining toner and the like are removed after an image is transferred. However, even if the surface of the image bearing member passes through the cleaning process, a part of toner and particles finer than the toner such as an external additive agent of the toner, and the like remain on the image bearing member without being cleaned and are adhered to the surface of the charging roll. The foreign materials adhered to the surface of the charging roll make the surface resistance value of the charging roll uneven and cause abnormal discharge and unstable discharge, by which charging uniformity is deteriorated.

There is proposed a cleaning system for scraping off the dirt on the surface of the charging roll by abutting a plate-shaped brush and sponge against the surface of the charging roll as a technology for overcoming the above problem. Further, a cleaning system for abutting a roll-shaped cleaning member against the surface of a charging roll is also proposed.

However, the above technologies are defective in that foreign materials gradually deposit on the surface of the cleaning member abutted against the charging roll and a cleaning performance is deteriorated by clogging with a result that the charging roll is made dirty.

SUMMARY

An image forming apparatus of an aspect of the invention includes an image bearing member, a charging roll that charges the image bearing member by rotating in contact with the image bearing member, and a cleaning member that removes materials adhered to the surface of the charging roll by contacting the surface of the charging roll. The cleaning member includes a foam body having an average cell diameter of 0.18 mm to 1.0 mm, and a ten point height of irregularities (Rz: JIS B0601-1982) of the charging roll is 1 μm to 17 μm.

BRIEF DESCRIPTION OF THE DRAWINGS

Exemplary embodiments of the present invention will be described in detail based on the following figures, wherein.

DETAILED DESCRIPTION

Exemplary embodiments of an image forming apparatus of the present invention will be explained below based on the drawings.

Figure 1:
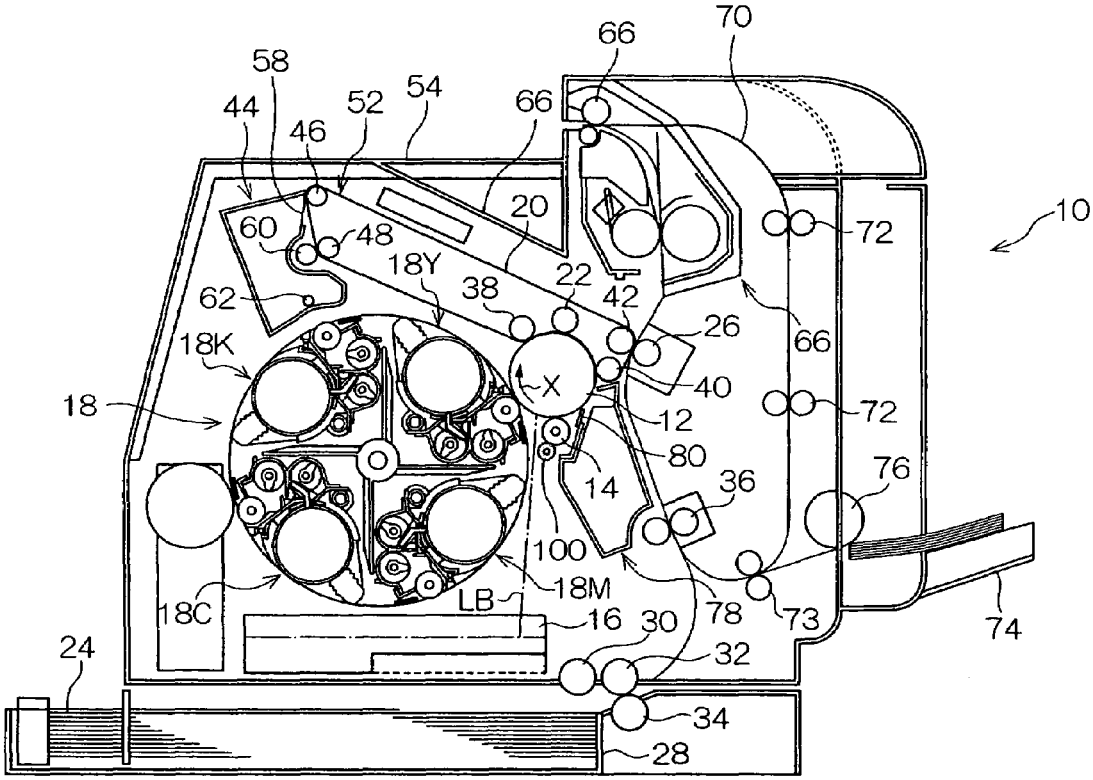
FIG. 1 is a schematic configurational view showing an image forming apparatus according to an exemplary embodiment of the present invention.

FIG. 1 shows a full color image forming apparatus 10 of a four-cycle system according to a first embodiment. A photosensitive drum 12 is rotatably disposed in the image forming apparatus 10 slightly upper right of the central portion thereof. An electrically conductive cylindrical member, which has a diameter of about 47 mm and a surface covered with a photosensitive layer composed of, for example, OPC and the like, is used as the photosensitive drum 12. The photosensitive drum 12 is driven in rotation by a not shown motor in the direction of an arrow X at a process speed of about 150 mm/sec.

After the surface of the photosensitive drum 12 is charged to a predetermined potential by a charging roll 14 disposed approximately just under the photosensitive drum 12, an image is exposed by a laser beam LB emitted from an exposure device 16 disposed below the charging roll 14, and an electrostatic latent image is formed on the photosensitive drum 12 according to image information.

The electrostatic latent image formed on the photosensitive drum 12 is developed by a rotary development device 18, in which development units 18Y, 18M, 18C, 18K of respective colors of yellow (Y), magenta (M), cyan (C), and black (K) are disposed in a peripheral direction, and made to toner images having predetermined colors.

At the time, charging, exposing and developing processes are repeated on the surface of the photosensitive drum 12 a predetermined number of times according to the colors of an image to be formed. In the developing process, the rotary development device 18 rotates, and development units 18Y, 18M, 18C, 18K corresponding to the colors move to developing positions confronting the photosensitive drum 12.

When, for example, a full color image is formed, the charging, exposing and developing processes are repeated on the surface of the photosensitive drum 12 four times corresponding to the respective colors of yellow (Y), magenta (M), cyan (C), and black (K), thereby toner images corresponding to yellow (Y), magenta (M), cyan (C), and black (K) are sequentially formed on the surface of the photosensitive drum 12. Although the number of times the photosensitive drum 12 rotates to form the toner images is different depending on the size of an image, when the image is formed in, for example, an A4 size, one image is formed by rotating the photosensitive drum 12 three times. More specifically, toner images corresponding to the respective colors of yellow (Y), magenta (M), cyan (C), and black (K) are formed on the surface of the photosensitive drum 12 each time the photosensitive drum 12 rotates three times.

The respective toner images of the respective colors of yellow (Y), magenta (M), cyan (C), and black (K) sequentially formed on the surface of the photosensitive drum 12 are transferred by a primary transfer roll 22 onto an intermediate transfer belt 20 in the state that they overlap each other at a primary transfer position at which the intermediate transfer belt 20 is wound on the outer periphery of the photosensitive drum 12.

The yellow (Y), magenta (M), cyan (C), and black (K) of the toner images, which are transferred onto the intermediate transfer belt 20 in a superimposed state, are collectively transferred by a secondary transfer roll 26 onto recording sheets 24 that are fed at a predetermined timing.

In contrast, the recording sheets 24 are fed by a pick-up roll 30 from a sheet feed cassette 28 disposed below the image forming apparatus 10 as well as fed in the state that they are separated one by one by a feed roll 32 and a retard roll 34 and transported to the secondary transfer position of the intermediate transfer belt 20 by a resist roll 36 in the state that they are synchronized with the toner images transferred onto the intermediate transfer belt 20.

The intermediate transfer belt 20 is stretched at a predetermined tension by a wrap-in roll 38, which specifies the wrap position of the intermediate transfer belt 20 upstream of the photosensitive drum 12 in the rotating direction thereof, a primary transfer roll 22 for transferring the toner images formed on the photosensitive drum 12 onto the intermediate transfer belt 20, a wrap-out roll 40 for specifying the wrap position of the intermediate transfer belt 20 on the downstream side of the wrap position, a backup roll 42 abutted against the secondary transfer roll 26 through the intermediate transfer belt 20, a first cleaning backup roll 46 confronting a cleaning device 44 of the intermediate transfer belt 20, and a second cleaning backup roll 48. The intermediate transfer belt 20 is rotated by the rotation of, for example, the photosensitive drum 12 so as to cyclically move at a predetermined process speed (about 150 mm/sec).

The intermediate transfer belt 20 is arranged such that, when it is stretched, the cross sectional shape thereof is formed in an approximately flat slender trapezoid shape to reduce the size of the image forming apparatus 10.

The intermediate transfer belt 20 constitutes an image forming unit 52 integrally with the photosensitive drum 12, the charging roll 14, the plurality of rolls 22, 38, 40, 42, 46, and 48 for stretching the intermediate transfer belt 20, the cleaning device 44 for the intermediate transfer belt 20, and a cleaning device 78 for the photosensitive drum 12 which will be described later. Accordingly, the overall image forming unit 52 can be removed from the image forming apparatus 10 by opening an upper cover 54 of the image forming apparatus 10 and lifting a gripper (not shown) disposed on the image forming unit 52 by hand.

In contrast, the cleaning device 44 of the intermediate transfer belt 20 includes a scraper 58 disposed so as to be abutted against the surface of the intermediate transfer belt 20 stretched by the first cleaning backup roll 46 and a cleaning brush 60 disposed so as to be pressed against the surface of the intermediate transfer belt 20 stretched by the second cleaning backup roll 48. Remaining toner, paper powder, and the like removed by the scraper 58 and the cleaning brush 60 are collected interior the cleaning device 44.

Note that the cleaning device 44 is disposed to swing counterclockwise in the figure about a swing shaft 62, evacuated to a position spaced apart from the surface of the intermediate transfer belt 20 until a final color toner image is secondarily transferred, and abutted against the surface of the intermediate transfer belt 20 on the completion of the second transfer of the final color toner image.

Further, the recording sheet 24 onto which the toner images are transferred from the intermediate transfer belt 20 are transported to a fixing device 64. Then, the toner images are heated and pressed by the fixing device 64 and fixed on the recording sheet 24. Thereafter, in case of one side print, the recording sheets 24 on which the toner images are fixed are discharged onto a discharge tray 68 disposed above the image forming apparatus 10 by discharging rolls 66.

In contrast, in case of both side print, each of the recording sheets 24 having the toner images fixed on a first surface (front surface) thereof is not discharged onto the discharge tray 68 as it is by the discharging rolls 66, and the discharging rolls 66 are rotated reversely in the state that the trailing edge of the recording sheet 24 is held by the discharging rolls 66. At the same time, a transportation path of the recording sheet 24 is switched to a both side sheet transportation path 70, the recording sheet 24 is transported again to the secondary transfer position of the intermediate transfer belt 20 after it is revered by transportation rolls 72 disposed to the both side sheet transportation path 70, and the toner images are transferred onto a second surface (backside surface) of the recording sheet 24. Then, the toner images on the second surface (backside surface) of the recording sheet 24 are fixed by the fixing device 64, and the recording medium 24 is discharged onto the discharge tray 68.

Further, as an option, a manual insertion tray 74 may be openably and closably mounted on a side of the image forming apparatus 10. An optional size and type of recording sheets 24 placed on the manual insertion tray 74 are fed by a feed roll 76 and transported to the secondary transfer position of the intermediate transfer belt 20 through transport rolls 73 and the resist roll 36, thereby it is possible to form an image also on the optional size and type of the recording sheets 24.

Note that, on the completion of the toner image transfer process, remaining toner, paper powder, and the like on the surface of the photosensitive drum 12 are removed by a cleaning blade 80 of the cleaning device 78 disposed obliquely under the photosensitive drum 12 each time it rotates once as a preparation for a next image forming process.

Figure 2:
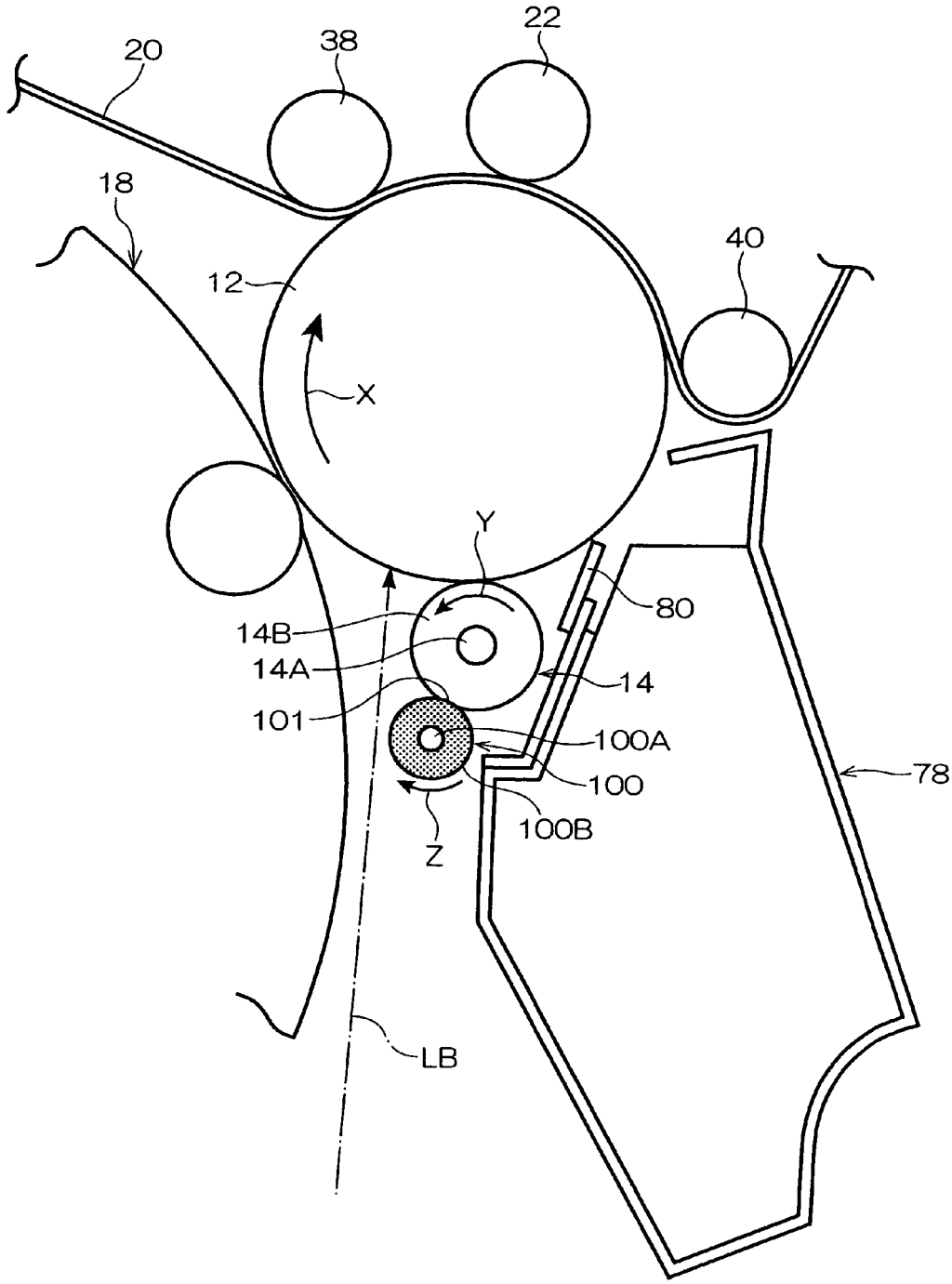
FIG. 2 is a view showing an arrangement of the peripheries of a charging roll and a cleaning member used to the image forming apparatus according to the exemplary embodiment of the invention.

As shown in FIG. 2, the charging roll 14 is disposed under the photosensitive drum 12 so as to come into contact with the photosensitive drum 12. The charging roll 14 is composed of a charging layer 14B formed around the periphery of an electrically conductive shaft 14A that is rotatably supported. A roll-shaped cleaning member 100 is disposed under the charging roll 14 on the side thereof opposite to the photosensitive drum 12 and comes into contact with the surface of the charging roll 14. The cleaning member 100 is composed a foaming layer 100B formed around the periphery of a shaft 100A, and the shaft 100A is rotatably supported.

The cleaning member 100 is pressed against the charging roll 14 with a predetermined load, thereby the foaming layer 100B is elastically deformed along the peripheral surface of the charging roll 14 and forms a nip portion 101. The photosensitive drum 12 is driven in rotation by the not shown motor in the direction of the arrow X, and the charging roll 14 is rotated by the rotation of photosensitive drum 12 in the direction of an arrow Y. Further, the roll-shaped cleaning member 100 is rotated by the rotation of the charging roll 14 in the direction of an arrow Z.

When the cleaning member 100 is rotated by the rotation of the charging roll 14 in contact therewith, dirt such as toner, an external additive agent, and the like on the surface of the charging roll 14 migrates to the cleaning member 100 and is cleaned.

Next, the cleaning member 100 will be explained in detail.

Free cutting steel, stainless steel, and the like are used as the material of the shaft 100A of the cleaning member 100, and the material and a surface treatment method are appropriately selected according to the purpose of use thereof such as a sliding property and the like. A material having no conductivity may be made conductive by being subjected to an ordinary treatment such as a plating treatment and the like. It is needless to say that the material may be used as it is. A material having strength for preventing the cleaning member 100 from flexing when it is nipped and a shaft diameter having sufficient rigidity with respect to a shaft length are selected to permit the cleaning member 100 to come into contact with the charging roll 14 through the foaming layer 100B with an appropriate nip pressure.

The foaming layer 100B is composed of a porous foaming member having a three dimensional structure. The material of the foaming layer 100B is selected from resin having a foaming property such as polyurethane, polyethylene, polyamide, polypropylene, and the like or rubber. Polyurethane, which is resistant against tearing, pulling, and the like, is particularly preferably used to the foaming layer 100B to permit the foaming layer 100B to effectively clean the foreign materials such as the external additive agent and the like when it is rotated by the charge roll 14 in sliding contact therewith as well as to prevent scratch from being generated on the surface of the charge roll 14 by the foaming layer 100B that grazes against the surface of the charging roll 14 and to prevent the foaming layer 100B from being torn off or broken for a long period of time.

Polyurethane is not particularly limited, and it is sufficient for it to be accompanied with a reaction of polyol such as polyester polyol, polyether polyester, acrylic polyol, and the like and isocyanate such as 2,4 tri-range isocyanate, 2,6 tri-range isocyanate, 4,4 diphenyl methane diisocyanate, tri-di-isocyanate, 1,6 hexa-methylene diisocyanate, and the like, and a chain extension agent such as 1,4 butanediol, tri(methylol propane), and the like is preferably mixed therewith. Further, polyurethane is ordinarily foamed using a foaming agent such as water and an azo compound, for example, azo dicarbon amide, azobis isobutyl etlyl. Further, auxiliary agents such as a foaming auxiliary agent, a foam adjuster, a catalyst, and the like may be added when necessary.

Figure 3:
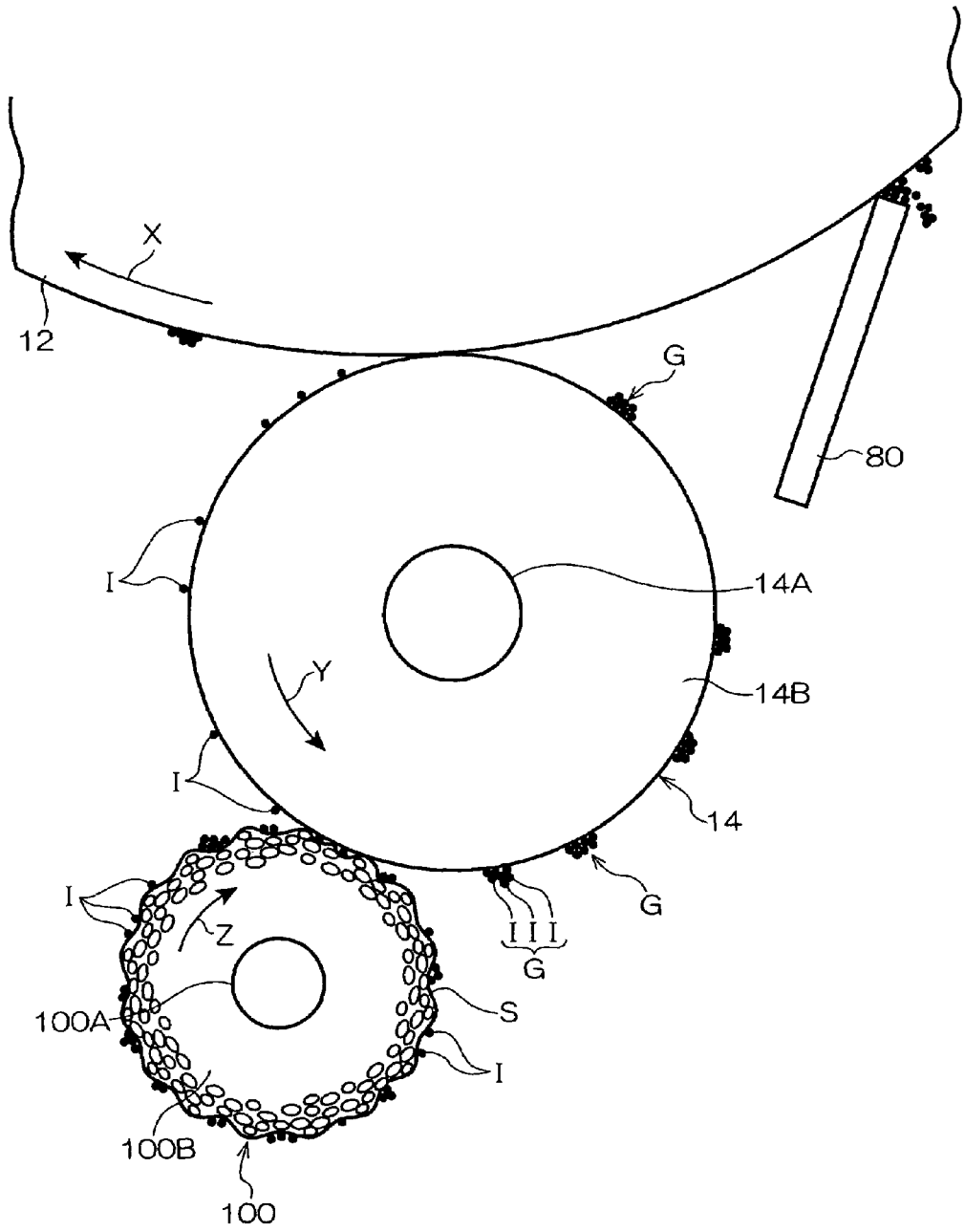
FIG. 3 is a view explaining a process for removing materials adhered to the charging roll and the cleaning member used to the image forming apparatus according to the exemplary embodiment of the invention.

As shown in FIG. 3, the foreign materials I such as the external additive agent, the toner, and the like adhered to the charging roll 14 are captured into cells S formed on the surface of the foaming layer 100B and aggregated and formed into aggregates G having an approximate size. The aggregates G having the appropriate size are returned from the foaming layer 100B to the charging roll 14 due to gravity, mechanical stress or the like, further reach the photosensitive drum 12, removed from the photosensitive drum 12 by the cleaning blade 80, and collected into the cleaning device 78. It is contemplated that since foreign materials are prevented from depositing on the foaming layer 100B by the above operation, a cleaning performance executed by the cleaning member can be successively maintained.

The cleaning member 100 for cleaning the charging roll 14 as described above has an average cell diameter of 0.18 mm to 1.0 mm. This is because when the average cell diameter is less than 0.18 mm, the foreign materials such as the external additive agent and the like are unlike to be captured into the cells, or even if they are captured thereinto, they remain in the cells without being discharged. Further, when the average cell diameter exceeds 1.0 mm, it is difficult to solidify the captured external additive agent to the appropriate size, and thus it is difficult to transfer it to the charging roll 14.

It is more preferable to set the number of the cells of the foaming layer 100B to 40 to 80 cells/25 mm. The average cell diameter can be easily set within the above range by setting the number of the cells to 80 cells/25 mm, and the average cell diameter set within the range permits the foreign materials such as the external additive agent and the like to be easily captured into the cells as well as permits the captured foreign materials to be easily transferred to the charging roll 14 and the photosensitive drum 12.

Note that the diameter of the cleaning member 100 is preferably ϕ8 mm to ϕ15 mm and more preferably ϕ9 mm to ϕ14 mm, and the thickness of the foaming layer 100B is preferably 2 mm to 4 mm. The diameter of the cleaning member 100 exceeding 15 mm is disadvantage from a view point of reduction in size of the image forming apparatus, although it is advantageous in the long-term stability of the cleaning performance because the number of times the one position of the peripheral surface of the cleaning member 100 comes into contact with the external additive agent decreases and further the number of times cleaning is executed also decreases. The diameter less than 9 mm is disadvantage to the long-term stability because the number of times the one position of the peripheral surface of the cleaning member 100 comes into contact with the external additive agent increases and further the number of times of cleaning increases, although it is advantageous to reduction in size of the image forming apparatus.

Next, the charging roll 14 will be described.

The charging roll 14 is composed of an electrically conductive shaft 14A around which an electrically conductive elastic layer as the charging layer 14B and a surface layer are sequentially formed.

The diameter of the charging roll 14 is preferably ϕ8 mm to ϕ15 mm and more preferably ϕ9 mm to ϕ14 mm, and the thickness of the charging layer 14B is preferably 2 mm to 4 mm. The diameter exceeding ϕ15 mm is disadvantageous from the view of reduction in size, although it is advantageous in the long term stability to dirt and a charging performance because the number of times the one position of the peripheral surface of the cleaning member 100 comes into contact with the external additive agent decreases and the number of discharge decreases. The diameter less than ϕ8 mm is disadvantage to the long-term stability because the number of times the one position of the peripheral surface of the cleaning member 100 comes into contact with the external additive agent increases and further the number of times of discharge increases, although it is advantageous to reduction in size of the image forming apparatus 10.

Further, the surface roughness of the charging roll 14 is set to 1 μm to 17 μm in terms of a ten point height of irregularities (Rz: JIS B0601-1982). This is because when it is less than 1 μm and more than 17 μm, the foreign materials such as the external additive agent and the like are unlike to be discharged from the cells of the cleaning member 100 to the charging roll 14 side in the relation to the average cell diameter of the cleaning member 100 described above, and thus a cleaning property is deteriorated by the dirt deposited on the cleaning member 100. Note that the surface roughness of the charging roll 14 is preferably 7.0 μm or less and more preferably 3.0 μm or less.

It is needless to say that the charging roll 14 is not limited to the following arrangement as long as it has a predetermined charging performance.

Free cutting steel, stainless steel, and the like are used as the material of the shaft 14A, and the material and a surface treatment method are appropriately selected according to the purpose of use thereof such as a sliding property and the like. A material having no conductivity may be made conductive by being subjected to an ordinary treatment such as a plating treatment and the like.

The electrically conductive elastic layer that constitutes the charging layer 14B of the charge roll 14 is composed of, for example, an elastic material such as rubber and the like having elasticity and an electrically conductive material such as carbon black, an ion conductive material, and the like for adjusting the resistance of the electrically conductive elastic layer. Further, materials that are ordinarily added to rubber such as a softening agent, plasticizer, hardener, vulcanizing agent, vulcanization accelerator, age resister, fillers such as silica, calcium carbonate, and the like, etc may be added when necessary. The charging roll 14 is formed by covering the peripheral surface of the electrically conductive shaft 14A with a mixed material added with the materials ordinarily added to rubber. A material, in which a material that is made electrically conductive using electrons and/or ions as a charge carrier is dispersed, may be used as an electrically conductive agent for adjusting a resistance value. The charge carrier is composed of carbon black and an ion conductive agent blended with a matrix material. Further, the elastic material may be foam.

The elastic member for constituting the electrically conductive elastic layer is formed by dispersing an electrically conductive agent in, for example, a rubber material. Exemplified as the rubber material is isoprene rubber, chloroprene rubber, epichlorohydrin rubber, butyl rubber, urethane rubber, silicone rubber, fluorine rubber, styrene-butadiene rubber, butadiene rubber, nitrile rubber, ethylene propylene rubber, epichlorohydrin-ethyleneoxide copolymer rubber, epichlorohydrin-ethyleneoxide-allylglycidylether copolymer rubber, ethylene-propylene-diene terpolymer rubber (EPDM), acrylonitrile-butadiene copolymer rubber, natural rubber, and the like, and blended rubber of them. Among them, silicone rubber, ethylene propylene rubber, epichlorohydrin-ethyleneoxide copolymer rubber, epichlorohydrin-ethyleneoxide-allylglycidylether copolymer rubber, acrylonitrile-butadiene copolymer rubber, and the like, and blended rubber thereof are preferably used. These rubber materials may be foamed or may not be foamed.

An electronic conductive agent and an ion conductive agent are used as the electrically conductive agent. Exemplified as the electronic conductive agent are fine powder of carbon black such as Ketjen black, acetylene black, and the like; thermally cracked carbon, graphite; various electrically conductive metals or alloys such as aluminum, copper, nickel, stainless steel, and the like; various electrically conductive metal oxides such as tin oxide, indium oxide, titanium oxide, tin oxide-antimony oxide solid solution, tin oxide-indium oxide solid solution, and the like; insulation materials whose surfaces are made electrically conductive, and the like. Further, exemplified as the ion conductive agent are perchlorate, chlorate, and the like such as tetraethyl ammonium, lauryl trimethyl ammonium, and the like; alkaline metal such as lithium, magnesium, and the like, perchlorate, chlorate, and the like of alkaline metal, alkaline earth metal.

These electrically conductive agents may be used singly or may be used in a combination of two or more kinds of them. Further, the additive amount of the electrically conductive agents is not particularly limited. However, in the case of electronic conductive agent described above, it is preferably added in the range of 1 to 60 parts by mass to 100 parts by mass of rubber. In contrast, in the case of ion conductive agent, it is preferably added in the range of 0.1 to 0.5 parts by mass to 100 parts by mass of rubber.

The surface layer that constitutes the charging layer 14B is formed to prevent the charging layer 14B from being made dirty by the foreign materials such as toner. The material of the surface layer is not particularly limited, and any of resin, rubber, and the like may be used. Exemplified as the material are polyester, polyimide, copolymer nylon, silicone resin, acrylic resin, polyvinyl butyral, ethylene tetrafluoroethylene copolymer, melamine resin, fluorine rubber, epoxy resin, polycarbonate, polyvinyl alcohol, cellulose, vinylidene polychloride, polyvinyl chloride, polyethylene, ethylene vinyl acetate copolymer, and the like.

Among these materials, vinylidene polyfluoride, ethylene tetrafluoride copolymer, polyester, polyimide, and copolymer nylon are preferably used from the view point of dirt of the external additive agent. The copolymer nylon contains any one kind or a plurality of kinds of nylon 610, nylon 11, nylon 12 as a unit of polymerization, and nylon 6, nylon 66, and the like are exemplified as other unit of polymerization included in the copolymer. The unit of polymerization composed of nylon 610, nylon 11, and nylon 12 is preferably included in the copolymer at the ratio by weight of at least 10% in total. When the unit of polymerization is 10% or more, an excellent liquid regulating property as well as an excellent film forming property when the surface layer is coated can be obtained. In particular, when the charging roll 14 is used repeatedly, the resin layer is less worn, foreign materials are less adhered to the resin layer, the roll has excellent durability, and characteristics are less changed by an environment.

The polymeric materials may be singly used or may be used in a combination of two or more kinds of them. The number average molecular weight of the polymeric materials is preferably within the range of 1,000 to 100,000 and more preferably within the range of 10,000 to 50,000.

Further, an electrically conductive material may be contained in the surface layer to adjust the resistance value. The electrically conductive material preferably has a particle size of 3 μm or less.

The material, in which the material that is made electrically conductive using electrons and/or ions as the charge carrier is dispersed may be used as the electrically conductive agent for adjusting the resistance value. The charge carrier is composed of carbon black, electrically conductive metal oxide particles, and an ion conductive agent blended with a matrix material.

Exemplified as the carbon black of the electrically conductive agent are "Special Black 350", "Special Black 100", "Special Black 250", "Special Black 5", "Special Black 4", "Special Black 4A", "Special Black 550", "Special Black 6", "Color Black FW200", "Color Black FW2", and "Color Black FW2V" each made by Degussa, "MONARCH 1000", "MONARCH 1300", "MONARCH 1400", "MOGUL-L", and "REGAL 400R" each made by Cabot, and the like.

The carbon black has pH of 4.0 or less, is excellent in a dispersing property into a resin composition due to the effect of an oxygen containing functional group existing on a surface as compared with ordinary carbon black. Blending the carbon black having pH of 4.0 or less can enhance charging uniformity and further can reduce fluctuation of the resistance value.

Electrically conductive metal oxide particles that are the electrically conductive particles for adjusting the resistance value are not particularly limited, and any electrically conductive agent may be used as long as it is composed of electrically conductive particles using electrons as a charge carrier such as tin oxide, tin oxide doped with antimony, zinc oxide, anatase titanium oxide, ITO, and the like. They may be singly used or may be used in a combination of two or more kinds of them. Although any particle size may be used as long as it does not inhibit the invention, tin oxide, tin oxide doped with antimony, and anatase titanium oxide are preferable, and further tin oxide and tin oxide doped with antimony are more preferable from the view point of adjustment of resistance value and strength.

The resistance value of the surface layer does not change depending on an environmental condition by controlling the resistance value by the above electrically conductive materials, thereby stable characteristics can be obtained.

Further, fluorine or silicone resin is used to the surface layer. In particular, the surface layer is preferably composed of fluorine denatured acrylate polymer. Further, fine particles may be added to the surface layer. The fine particles act to prevent adhesion of foreign materials to the charging roll 14 because the surface layer is made hydrophobic. Further, it is also possible to provide the surface of the charging roll 14 with irregularity by adding insulating particles such as alumina and silica to the surface layer so that the wear resistance of the charging roll 14 and the photosensitive drum 12 can be improved by reducing a load of the charging roll 14 when it is rotated in sliding contact with the photosensitive drum 12.

A developer used to the image forming apparatus 10 preferably contains spherical silica as the external additive agent. This is because since silica has a refraction index of about 1.5, even if the particle size thereof is increased, it does not affect reduction of a degree of transparency caused by dispersed light, in particular, a PE value (index of light transparency) and the like when an image is formed on the surface of an OHP.

In contrast, ordinary fumed silica has a specific gravity of 2.2 and a maximum particle size may be limited to 50 nm in production. Although the particle size thereof may be increased by forming it to aggregates, the aggregates may not stably exhibit a seal effect because it is difficult to uniformly disperse them.

Silica, which is suitable as a material of the external additive agent contained to improve the cleaning property, in particular, singly dispersed spherical silica having a specific gravity of 1.3 to 1.9 can be obtained by a sol-gel method as a wet method. Since the sol-gel method is the wet method and can manufacture silica without baking it, the method can control the specific gravity to a small value as compared with other methods such as a vapor-phase oxidation method and the like. In addition, the method can further adjust the specific gravity by controlling a type of a hydrophobic treatment agent used in a hydrophobic treatment process or controlling an amount of treatment. The particle size of silica can be optionally controlled by hydrolysis executed by the sol-gel method, the mass ratio of alkoxysilane, ammonia, alcohol, and water in an aggregation polymerization process, a reaction temperature, a stirring speed, and a feed speed. It is possible to manufacture the simply dispersed spherical silica by the sol-gel method.

A specific method of manufacturing silica is as described below.

First, a silane compound such as tetramethoxysilane and the like is dropped into a mixed solution of water and alcohol and stirred using ammonium water as a catalyst while increasing a temperature. Next, the thus created silica sol slurry is subjected to centrifugal separation so that it is separated to wet silica gel, alcohol, and ammonia water. The wet silica gel is made to a silica sol state again by adding a solvent thereto, and the surface of the silica is made hydrophobic by adding a hydrophobic treatment agent thereto. An ordinary silane compound can be used for the hydrophobic treatment. Next, after the solvent is removed from the silica sol subjected to the hydrophobic treatment, the silica sol is dried and sieved to thereby obtain target silica. Further, the thus obtained silica may be subjected to the treatment by the sol-gel method again.

Further, polymeric toner made by a polymerization method is preferably used as the toner of the developer used in the image forming apparatus 10. Toner may have insufficient fluidity even if a fluidization auxiliary agent is added thereto because its shape is indefinite. That is, the fluidity of the toner is deteriorated with time because fine particles on the surface of the toner migrate to the recesses thereof due to mechanical shear force applied to the toner while it is used, or the developing property, transfer property and cleaning property of the toner are deteriorated because the fluidization auxiliary agent is buried in the toner. Further, when the toner collected by cleaning is returned to the development device and reused, image quality is liable to be further deteriorated. When the additive amount of the fluidization auxiliary agent is further increased to prevent the drawback, a photosensitive member is made dirty, and filming, scratch, and the like are generated to the photosensitive member.

To cope with the above problems, there is proposed a method of manufacturing toner by an emulsifying polymerization aggregation method as a means for intentionally controlling the shape and the surface structure of toner. According to the method, toner is generally manufactured as described below. A resin fine particle dispersing liquid is made by a polymerization method such as emulsifying polymerization and the like, a coloring agent particle dispersing liquid composed of a coloring agent dispersed in a solvent is made. After these liquids are mixed, they are aggregated by heating and/or pH control, addition of an aggregation agent, and the like until the resin fine particles and the coloring agent have a desired particle size. Thereafter, the aggregated particles are stabilized in the desired particle size and fused together by being heated at a temperature exceeding the glass transfer temperature of the resin fine particles.

The toner particles obtained by the emulsifying polymerization aggregation method exhibit a very excellent particle size distribution characteristic (in particular, particles are distributed sharp, and it is not necessary to sort them) as compared with the toner particles obtained by other polymerization methods represented by a conventional suspension polymerization method. High quality images can be obtained for a long period of time by using the thus obtained toner. Further, according to the toner manufacturing method employing the emulsifying polymerization aggregation method, since the aggregated particles are fused by being heated to the temperature exceeding the glass transfer temperature (Tg) of the resin fine particles, it is possible to manufacture toner having various shapes ranging from an indefinite shape to a spherical shape depending on a manner of heating and pH control. Accordingly, it is possible to select toner shapes in the range from a so-called potato shape to a spherical shape in an electrophotographic system in use.

Further, the photosensitive drum 12 preferably contains polytetrafluoroethylene. According to the above arrangement, since foreign materials are unlike to adhere to the photosensitive drum 12, an image can be favorably formed.

Further, a voltage of AC+DC may be applied as a charging system for charging the photosensitive drum 12. The charging roll can be preferably cleaned by employing the AC+DC application system.

Next, a test for evaluating the cleaning property of the charging roll 14 cleaned by the cleaning member 100 will be explained.

The cleaning property is tested using cleaning members 100 each having a foaming layer 100B whose average cell diameter is different and charging rolls 14 each having a different surface roughness.

As a method of evaluating the cleaning property, in the image forming apparatus 10 shown in FIG. 1, the charging roll 14 has been previously made dirty by executing a print test without mounting the cleaning member 100 thereon, and then only the photosensitive drum 12, the charging roll 14, and the cleaning members 100 are disposed, and the change of the surface of the charging roll 14 is measured by rotating the photosensitive drum 12 a predetermined number of times. As a measuring method at the time, the threshold value of a degree of whiteness resulting from an external additive agent adhered to the surface of the charging roll 14 and the threshold value of a degree of whiteness resulting from an external additive agent adhered to the surfaces of the cleaning member 100 are set. Then, a case in which the degree of whiteness of the charging roll 14 exceeded the threshold value is shown by C, a case in which although the degree of whiteness of the charging roll 14 is equal to or less than the threshold value, the degree of whiteness of the cleaning member 100 exceeded the threshold value is shown by B, and a case in which the degrees of whiteness of both the charging roll 14 and the cleaning member 100 are equal to or less than the threshold value is shown by A. That is, C shows that the cleaning property itself is bad, B shows that although the cleaning property is good, the aggregates of the external additive agent migrate from the cleaning member 100 to the charging roll 14, and A shows that the cleaning property is good and the aggregates of the external additive agent is liable to migrate from the cleaning member 100 to the charging roll 14. Table 1 shows a result of the test.

TABLE 1

| | | Average cell diameter of cleaning member | | | | | |
|---|---|---|---|---|---|---|---|
| | | 0.10 mm | 0.18 mm | 0.42 mm | 0.62 mm | 1.0 mm | 1.5 mm |
| Rz of charging roll | 0.5 μm | C (Dirt remaining in recess) | C | C | C | C | C (Uneven dirt of charger) |
| | 1 μm | C (Wear of charger surface) | A | A | A | A | C (Uneven dirt of charger) |
| | 3 μm | C (Wear of charger surface) | A | A | A | A | C (Uneven dirt of charger) |
| | 4.5 μm | C (Wear of charger surface) | A | A | A | A | C (Uneven dirt of charger) |
| | 7 μm | C (Wear of charger surface) | A | A | A | A | C (Uneven dirt of charger) |
| | 13 μm | C (Dirt remaining in recess) | B | B | B | B | C (Uneven dirt of charger) |
| | 15 μm | C (Dirt remaining in recess) | B | B | B | B | C (Uneven dirt of charger) |
| | 17 μm | C (Dirt remaining in recess) | B | B | B | B | C (Uneven dirt of charger) |
| | 19 μm | C (Dirt remaining in recess) | C | C | C | C | C (Uneven dirt of charger) |

It can be found from the result shown in Table 1 that the cleaning member 100 has a good cleaning property when it has an average cell diameter of from 0.18 mm to 1.0 mm.

Further, the charging roll 14 can obtain a good cleaning property when it has a surface roughness of 1 μm to 17 μm in terms of the ten point height of irregularities (Rz: JIS B0601-1982) and can obtain a good cleaning property and a good migration property of the aggregates from the cleaning member to the charging roll when it has the surface roughness of 1 μm to 7.0 μm.

Figure 4:
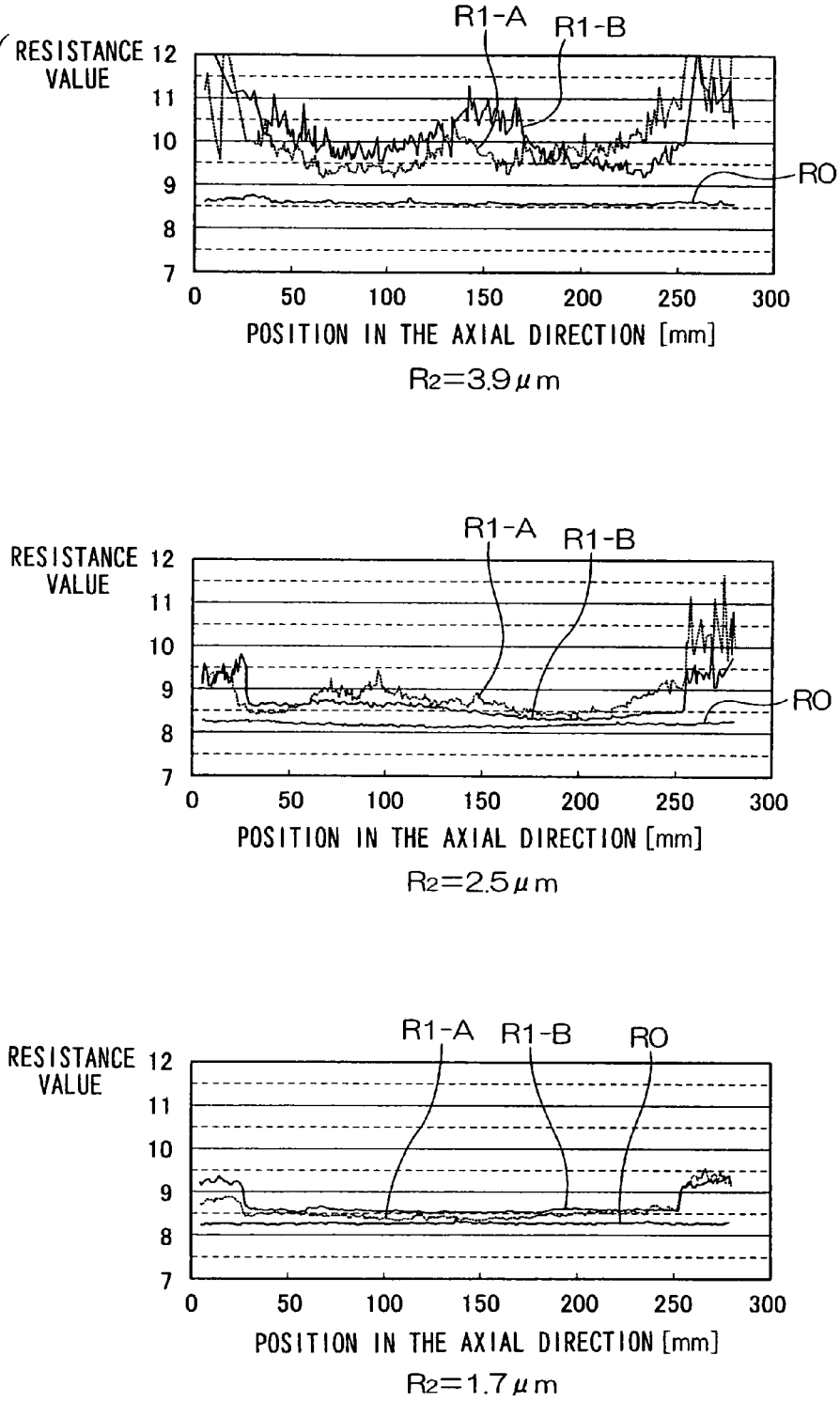
FIG. 4 is a graph showing the resistance values in an axial direction in the respective different surface roughnesses of the charging roll used to the image forming apparatus according to the exemplary embodiment of the invention before and after the charging roll is used.
Figure 5:
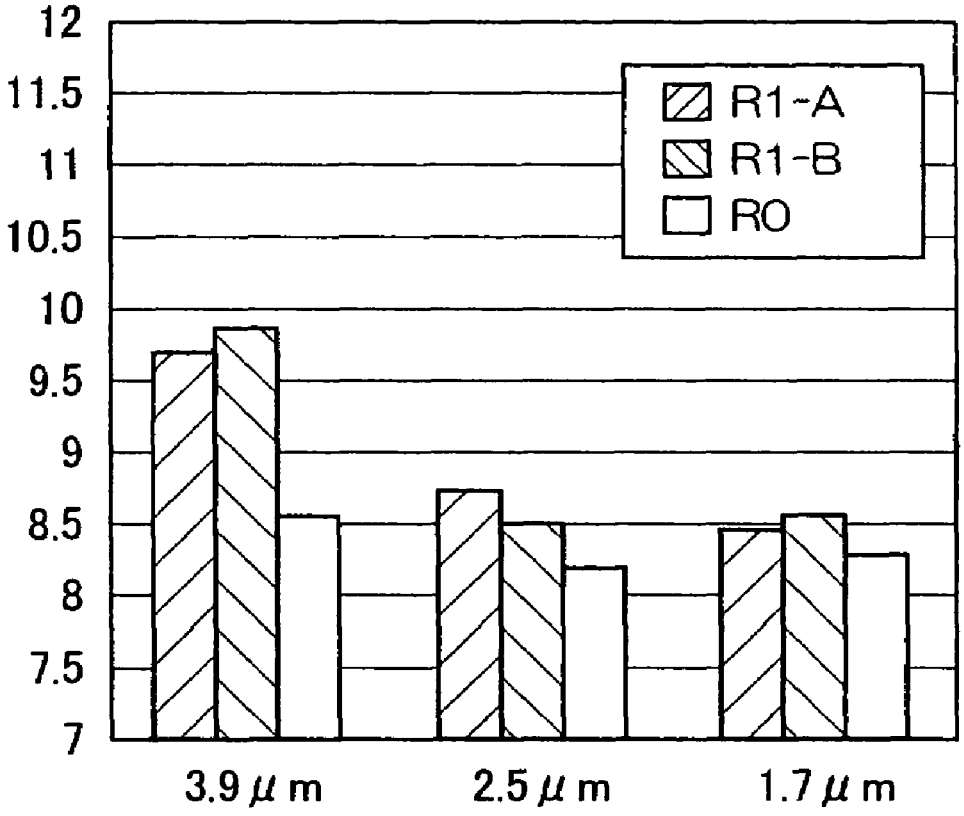
FIG. 5 is a graph showing the resistance values in the respective different surface roughnesses of the charging roll used to the image forming apparatus according to the exemplary embodiment of the invention before and after the charging roll is used.

Further, a resistance value is evaluated by SARM-D to compare minute amounts of deposition. Charge rolls 14 having the 10-point surface roughness of 3.9 μm, 2.5 μm, and 1.7 μm are prepared, and an initial resistance value R0 before adhesion of dirt and an after-use resistance value R1 after the photosensitive drum 12, the charging roll 14, and the cleaning member 100 are rotated a predetermined number of times are measured. The after-use resistance value R1 nearer to the initial resistance value R0 shows that a smaller amount of the external additive agent and the like adheres to the charging roll 14 and that the cleaning member 100 has a high cleaning property. FIGS. 4 and 5 show a result of the test. FIG. 4 shows the initial resistance values R0 and the after-use resistance values R1-A and R1-B in an axial direction in the respective surface roughnesses. Further, FIG. 5 shows a graph that compares the average initial resistance values R0 with the average after-use resistance values R1-A and R1-B in the axial direction in the respective surface roughnesses. Note that the after-use resistance values R1-A and R1-B are values measured at different fixed positions of the same charging roll 14 in the peripheral direction thereof.

From FIGS. 4 and 5, a result of 1.7 μm>2.5 μm>>3.9 μm is obtained in the order of a smaller amount of adhesion and a higher cleaning property. When the surface roughness of the charging roll 14 is 3.9 μm, the amount of adhesion significantly increases. It is contemplated that this is because the aggregates of the external additive agent captured into the cleaning member 100 insufficiently migrates to the charging roll 14 side as compared with the charging rolls 14 having a surface roughness other than that of the above charging roll 14. It can be said that the ten point height of irregularities (Rz: JIS B0601-1982) of the charging roll 14 is preferably 3.0 μm or less when a minute amount of adhesion is also taken into consideration.

Figure 6:
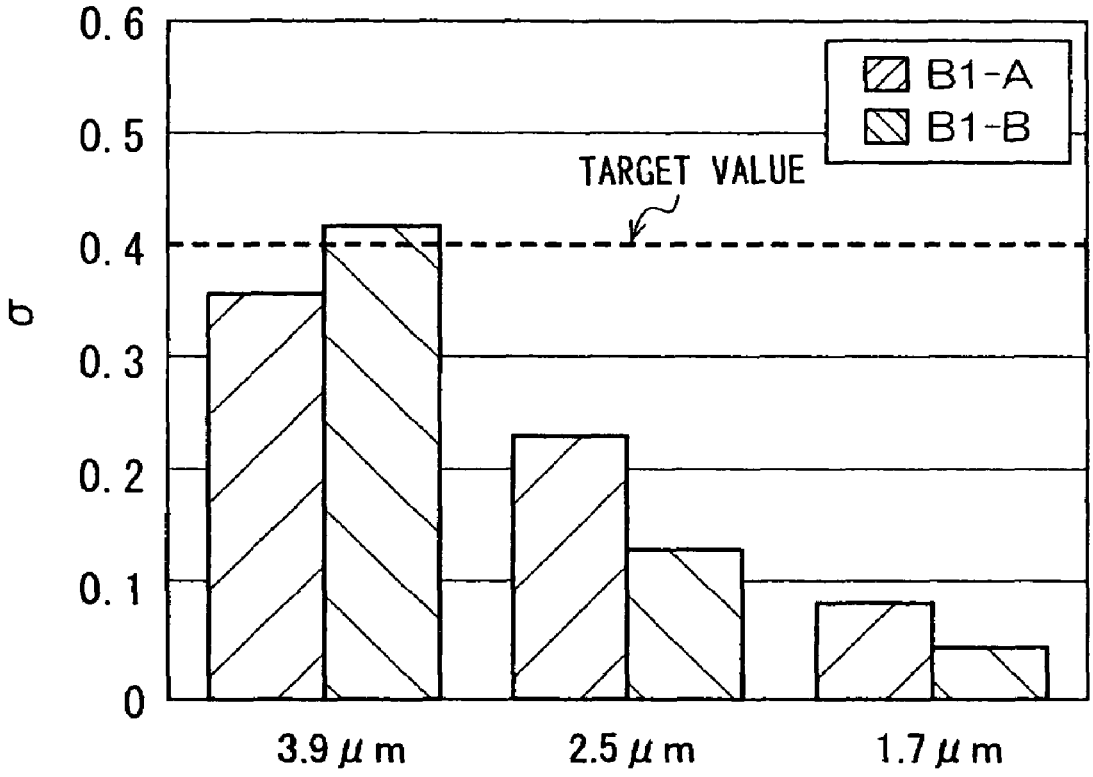
FIG. 6 is a graph showing the dispersion of resistance values in the respective different surface roughnesses of the charging roll used to the image forming apparatus according to the exemplary embodiment of the invention before and after the charging roll is used.

FIG. 6 shows the dispersion a of the resistance values in the axial direction in SRAM-D. Dispersions B1-A and B1-B correspond to the after-use resistance values R1-A and R1-B. When the dispersion σ is smaller than a value set as a target value of the dispersion σ, it can be evaluated that dirt is equal to or less than a predetermined amount. In FIG. 6, the dispersion B1-B of the charging roll 14 having the ten point height of irregularities (Rz: JIS B0601-1982) of 3.9 μm exceeds the target value. Further, although the dispersion B1-A is less than the target value, it is near to it. It can be found also from this point that the charging roll 14 having the ten point height of irregularities (Rz: JIS B0601-1982) of 3.9 μm has a lower cleaning property than that of the charging rolls 14 whose ten point height of irregularities (Rz: JIS B0601-1982) is 2.5 μm and 1.7 μm.

In the present exemplary embodiment, since the average cell diameter of the cleaning member 100 is set to 0.18 mm to 1.0 mm and the surface roughness of the charging roll 14 is set to 1 μm to 17 μm in terms of the ten point height of irregularities (Rz: JIS B0601-1982), the cleaning property thereof can be enhanced.

In addition, the cleaning property can be more enhanced by setting the surface roughness of the charging roll 14 to 1 μm to 7.0 μm in terms of the ten point height of irregularities (Rz: JIS B0601-1982).

Further, the cleaning property can be further enhanced by setting the surface roughness of the charging roll 14 to 1 μm to 3.0 μm in terms of the ten point height of irregularities (Rz: JIS B0601-1982).

Note that although the cleaning member 100 is rotated by the rotation of the charging roll 14, it may be rotated through a gear rotated by the rotation of the charging roll 14. When the rotating speed of the cleaning member 100 is made different from the charging roll 14 by adjusting the size of the gear, and the like, the cleaning effect can be enhanced by the friction of the contact portion between the cleaning member 100 and the charging roll 14.

Note that although the image forming apparatus 10 of the present exemplary embodiment repeats formation of toner images onto the photosensitive drum 12 four cycles using the rotary development device 18, the present exemplary embodiment is not limited to the arrangement. That is, even when, for example, yellow, magenta, cyan, and black image forming units are disposed along the moving direction of the intermediate transfer belt, the invention can be applied to photosensitive drums, charging rolls, and roll-shaped sponge members of the respective image forming units.

EXAMPLES

The charging roll 14 and the cleaning member in the above embodiment are made as described below. Note that although polyol, a foaming agent, a foam adjuster, and a catalyst are ordinarily mixed in a method of manufacturing the foamed urethane used to the cleaning member 100 in the following examples by controlling the cell diameter thereof, the size of the cell diameter can be controlled by changing the mixing ratio thereof. Further, as a measuring method of the cell diameter, the numbers of cells in 25 mm long portions at three optional positions of the cleaning member 100 are counted and a quotient obtained by dividing 25 mm by the number of cells is used as the cell diameter.

[Charging Roll]

After 100 parts by mass of epichlorohydrin rubber is added with 3 parts by mass of ion conductive agent PEL-100 (made by Japan Carlit) and sufficiently kneaded it is extrusion molded. After a SUM-Ni shaft (composed of sulfur free cutting steel on which nickel is plated) having a diameter of ϕ6 mm is inserted into the epichlorohydrin rubber, the rubber is molded and by a press molding machine and vulcanized. Thereafter, the molded epichlorohydrin rubber is polished to such a desired outside diameter that the outside diameter is set to ϕ11.95 mm at an outside diameter edge and to ϕ12.0 mm at a central portion. Thereafter, fluorine resin is coated on the surface of the thus obtained charging roll to a film thickness of 5 μm by a dip coating method. Charge rolls having Rz of 0.5 μm, 1 μm, 3 μm, 4.5 μm, 7 μm, 13 μm, 15 μm, 17 μm, and 19 μm are made by changing a condition when they are polished.

[Cleaning Member 1]

Polyether is mixed with isocyanate, and resultant urethane resin is heated and hardened. A resultant urethane material (EP70 made by INOAC) composed of a three dimensional net structure is cut, and a metal shaft (composed of ϕ5 mm sulfur free cutting steel on which nickel is plated) is inserted thereinto. Then, the urethane material is machined to a diameter of ϕ9.0 mm using a grinding machine. Note that a cleaning member manufactured here has an average cell diameter of 0.42 mm.

[Cleaning Member 2]

Polyether is mixed with isocyanate, and resultant urethane resin is heated and hardened. A resultant urethane material (ER26 made by INOAC) composed of a three dimensional net structure is cut, and a metal shaft (composed of ϕ5 mm sulfur free cutting steel on which nickel is plated) (SUM-Ni) is inserted thereinto. Then, the urethane material is machined to a diameter of ϕ9.0 mm using an NC cylindrical grinding machine. Note that a cleaning member manufactured here has an average cell diameter of 0.62 mm.

[Cleaning Member 3]

Polyether is mixed with isocyanate, and resultant urethane resin is heated and hardened. A resultant urethane material (poron L24 made by INOAC) composed of a three dimensional net structure is cut, and a metal shaft (composed of ϕ5 mm sulfur free cutting steel on which nickel is plated) (SUM-Ni) is inserted thereinto. Then, the urethane material is machined to a diameter of ϕ9.0 mm using an NC cylindrical grinding machine. Note that a cleaning member manufactured here has an average cell diameter of 0.1 mm.

[Cleaning Member 4]

Polyether is mixed with isocyanate, and resultant urethane resin is heated and hardened. A urethane material (Endur made by INOAC) composed of a three dimensional net structure is made by extrusion molding, and a metal shaft (composed of ϕ5 mm sulfur free cutting steel on which nickel is plated) (SUM-Ni) is inserted thereinto. Then, the urethane material is machined to a diameter of ϕ9 mm using an NC cylindrical grinding machine. Note that a cleaning member manufactured here has an average cell diameter of 0.18 mm.

[Cleaning Member 5]

When it is tried to manufacture a urethane material having a larger cell diameter, it is difficult to process the urethane material having the larger cell diameter to a small diameter roll by the present technology. Accordingly, when a cleaning member manufactured by the same manner as the cleaning member 1 is partly exfoliated with a tweezer, a cleaning member having a cell diameter of about 1.0 mm can be manufactured. However, since it is difficult to subject the entire region of the cleaning member to the additional processing, the portion thereof subjected to the processing is limited to a width of 25 mm in an axial direction.

[Cleaning Member 6]

When a cleaning member manufactured by the same manner as the cleaning member 1 is partly exfoliated with a tweezer likewise the cleaning member 5, a cleaning member having a cell diameter of about 1.5 mm can be manufactured. Since it is difficult to subject the entire region of the cleaning member of the comparative example to the additional processing, the portion thereof subjected to the processing is limited to a width of 25 mm in an axial direction.

The charging roll and the cleaning members 1 to 6 manufactured as described above are assembled to a printer DocuPrint C525A manufactured by Fuji Xerox after it is so that the cleaning members can be mounted thereon, and an image is printed on 25000 sheets traveled therethrough. Table 1 shows a result of evaluation of image quality. As a standard of judgment of the image quality, a degree of deterioration to the image quality at initiation of evaluation (image quality of a first sheet) is sensuously evaluated.

It can be found from Table 1 that when the cell diameter is 0.18 mm, 0.42 mm, 0.62 mm, and 1.0 mm, the charging roll can be cleaned well for a long period of time and stable image quality can be obtained. In addition, the surface of the charging roll is ground and worn by the materials (mainly an external additive agent as toner) removed from the charging roll on which they deposit, thereby image quality is deteriorated. In a combination of a small ten point surface roughness Rz (Rz=1 μm) and a small cell diameter (0.1 mm), dirt removed from the charging roll is deposited in the cells and the cells are clogged with the dirt, thereby the cleaning property is deteriorated. In contrast, in a combination of a large ten point surface roughness Rz (Rz=19 μm) and a small cell diameter (0.1 mm), dirt in the bottoms of the irregular portions (components of roughness) on the surface of the charging roll cannot be removed. As a result, dirt is partly deposited on the surface of the charging roll, thereby image quality is deteriorated. Further, when the cell diameter exceeds 1.0 mm, since the surface of the charging roll cannot be uniformly cleaned regardless of the ten point surface roughness (Rz) of the charging roll, the surface of the charging roll is made dirty unevenly. As a result, the image quality is deteriorated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image bearing member;

a charging roll that charges the image bearing member by rotating in contact with the image bearing member; and a cleaning member that removes materials adhered to the surface of the charging roll by contacting the surface of the charging roll, wherein the cleaning member includes a foam body having an average cell diameter of 0.18 mm to 1.0 mm, and a ten point height of irregularities (Rz: JIS B0601-1982) of the charging roll is 1 μm to 17 μm.

2. The image forming apparatus according to claim 1, wherein the ten point height of irregularities (Rz: JIS B0601-1982) of the charging roll is 1 μm to 7.0 μm.

3. The image forming apparatus according to claim 1, wherein the ten point height of irregularities (Rz: JIS B0601-1982) of the charging roll is 1 μm to 3.0 μm.

4. The image forming apparatus according to claim 1, wherein the number of cells of the cleaning member is from 40 (cells/25 mm) to 80 (cells/25 mm).

5. The image forming apparatus according to claim 1, wherein spherical silica is contained in a developer used for developing an electrostatic latent image formed on the image bearing member.

6. The image forming apparatus according to claim 1, wherein the image bearing member contains polytetrafluoroethylene.

7. The image forming apparatus according to claim 1, wherein the toner contained in a developer used for developing an electrostatic latent image formed on the image bearing member is polymerized toner.

8. The image forming apparatus according to claim 1, wherein a charging system of the charging roll is an AC+DC application system.

9. The image forming apparatus according to claim 1, wherein the cleaning member comprises foamed urethane resin.

10. The image forming apparatus according to claim 1, wherein materials adhered to the surface of the charging roll are captured into the cells and made into aggregates.

11. The image forming apparatus according to claim 10, wherein when the aggregates become an appropriate size, the aggregates are shifted from the cells to the image bearing member via the charging roll.

12. A cleaning method for an image forming apparatus including an image bearing member, a charging roll that charges the image bearing member by contact-charging and a cleaning member that cleans a surface of the charging roll, the method comprising:

forming at least a surface layer of the cleaning member with a foam body having a plurality of cells;

removing materials adhered to the surface of the charging roll by bringing the surface layer of the cleaning member into contact with the surface of the charging roll;

aggregating the removed materials in each of the plurality of cells in the foam body;

growing the aggregated materials in each of the plurality of cells by further aggregation; and releasing the grown aggregated materials from each of the plurality of cells in the foam body to the surface of the charging roll.

13. The cleaning method according to claim 12, wherein the grown aggregated materials are released from each of the plurality of cells by at least one of gravity and mechanical stress.

14. The cleaning method according to claim 12, further comprising: transferring the grown aggregated materials from the surface of the charging roll to a surface of the image bearing member; and collecting the grown aggregated materials on the surface of the image bearing member.

* * * * *